US009975000B1

(12) United States Patent
Fumo

(10) Patent No.: US 9,975,000 B1
(45) Date of Patent: May 22, 2018

(54) GLUTEAL MUSCLES EXERCISE DEVICE

(71) Applicant: Nelson Fumo, Tyler, TX (US)

(72) Inventor: Nelson Fumo, Tyler, TX (US)

( * ) Notice: Subject to any disclaimer, the term of this patent is extended or adjusted under 35 U.S.C. 154(b) by 35 days.

(21) Appl. No.: 15/396,920

(22) Filed: Jan. 3, 2017

(51) Int. Cl.

| | |
|---|---|
| ***A61H 15/00*** | (2006.01) |
| ***A63B 23/04*** | (2006.01) |
| ***A63B 21/00*** | (2006.01) |
| ***A63B 23/02*** | (2006.01) |
| ***A63B 23/12*** | (2006.01) |

(52) U.S. Cl.
CPC ..... *A63B 23/04* (2013.01); *A63B 21/4035* (2015.10); *A63B 23/0205* (2013.01); *A63B 23/0233* (2013.01); *A63B 23/1236* (2013.01)

(58) Field of Classification Search
CPC ..... A63B 2023/006
See application file for complete search history.

(56) References Cited

U.S. PATENT DOCUMENTS 6,692,418 B2 * 2/2004 Shahan ..... A63B 23/02 482/143

* cited by examiner

*Primary Examiner* — Loan H Thanh
*Assistant Examiner* — Rae Fischer

(57) ABSTRACT

A device for exercising the gluteal muscles. The device is simple, small, portable, and lightweight, comprised of a half roll with a handle in each end. The user, facing down on top of the device at the level of the hip bones, must keep the legs high in a cantilever position which will exercise the gluteal muscles. To keep the legs in cantilever, the hamstrings muscles, lower back muscles, arm muscles, and core muscles are also exercised; the latter muscles are especially exercised if the upper body does not rest on a surface and is used for balance.

1 Claim, 1 Drawing Sheet

GLUTEAL MUSCLES EXERCISE DEVICE

CROSS-REFERENCE TO RELATED APPLICATIONS

Provisional patent application number U.S. 62/372,905.

STATEMENT REGARDING FEDERALLY SPONSORED RESEARCH

Not Applicable.

REFERENCE TO SEQUENCE LISTING, A TABLE, OR A COMPUTER PROGRAM

Not Applicable.

BACKGROUND OF THE INVENTION

The field of disclosure of this invention relates to an exercise device. More specifically, a device for exercising the gluteal muscles that also exercises the hamstrings muscles. For balancing, the lower back, arms and core muscles are also strengthened. Therefore, the invention may apply to the class number and title: 482 Exercise devices.

In the search of references (related products), no one similar to the one being disclosed was found. A device that might look similar is the roll abdominal wheel but is used to exercise abdominal muscles.

BRIEF SUMMARY OF THE INVENTION

The most common exercises for gluteal muscles are the squats and the lunges. As strength is gained, hand and bar weights are incorporated requiring more concentration for balancing and coordination, which is not needed with this invention. Other apparatuses for exercising the gluteal muscles require a frame which makes the apparatus bulky and heavy, and of course, not portable. Solutions for developing specific portions of the body require less effort, which make the exercise more effective, which is the idea of this invention.

The invention is a device for exercising the gluteal muscles. The device facilitates the use of the legs as weight to exercise the gluteal muscles. The user, facing down on top of the device at the level of the hip bones, must keep the legs high in a cantilever position which will exercise also the hamstrings muscles. However, its use will require, and strength, also the lower back muscles, arm muscles, and core muscles, especially if the upper body is used for balance. The device could also be used to facilitate abdominal exercises and pushups.

The device is simple, small, portable, and lightweight, comprised of a half roll (half cylinder) with two handles, one at each end of the half roll.

DETAILED DESCRIPTION OF THE INVENTION

Figure 1:
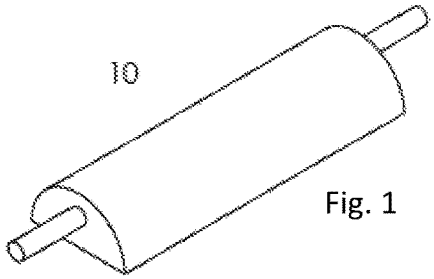
FIG. 1 Shows an ISO view of the device.
Figure 2:
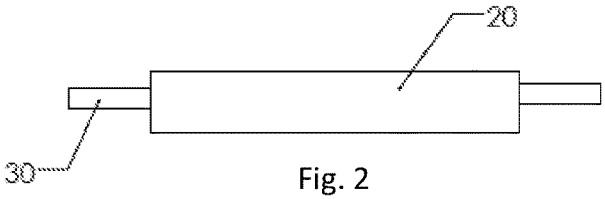
FIG. 2 Shows a front view of the device.
Figure 3:
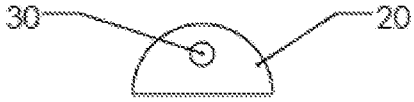
FIG. 3 Shows a lateral view of the device.

Referring to the figures (drawings), the exercise device presented in this disclosure is shown in FIGS. 1 to 3, and generally referenced to by numeral 10.

The half roll (half cylinder) 20 has at both ends of its longitudinal axes two handles 30. Although no shown in the figure, the half roll can be raised to raise the handles from the support surface (floor, table, etc.). To give structural resistance to the device, the handles can be part of a handlebar that runs along the half roll.

Figure 4:
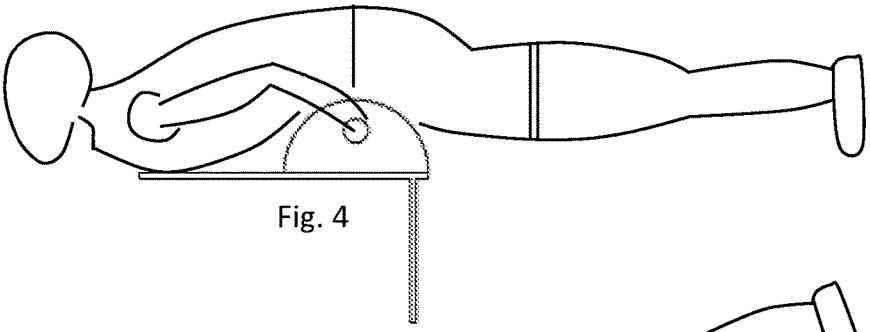
FIG. 4 Shows an sketch of a user exercising with the device on top of a table.
Figure 5:
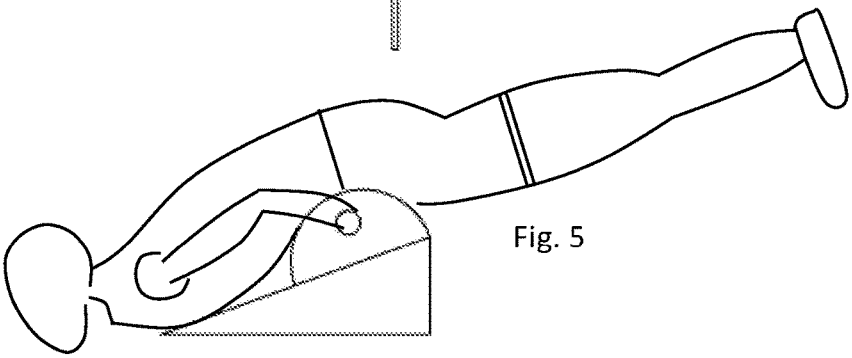
FIG. 5 Shows an sketch of a user exercising with the device, which is on top of a tilted surface on the floor.

The flat surface of the half roll (half cylinder) 20 is used to place the device in contact with the support surface (floor, table, etc.), while the curved surface is used to rest the hip bones. The user grabs the handles 30 and raises the legs to perform the exercise as shown in FIGS. 4 and 5. Due to the weight of the legs, the user needs to grab the handles firmly to keep the balance. To facilitate the balance, the user can rest the chest on the surface.

To perform the exercise, the user can just keep the legs straight or do different movements such as crossing the legs or any swim kicks. Weight can be added to the ankles to increase the effort.

In the prototype shown in the pictures of FIG. 6, a tube is used as a handlebar. However, the handles 30 could be removable to make the device smaller for storage and shipping purposes.

What is claimed is:

1. A device for exercising the gluteal muscles, consisting of:

a half cylinder having a longitudinal axis;

a handlebar disposed within the half cylinder and oriented colinear with the longitudinal axis of the half cylinder; and two handles, each having a longitudinal axis, wherein each handle is attached to the handlebar at opposite ends of the half cylinder and extending outside of the half cylinder and colinear with the longitudinal axis of the half cylinder, wherein the half cylinder is configured to rest on a flat surface, wherein the half cylinder is configured to support a user resting on the curved surface of the half cylinder, wherein the half cylinder is configured to rest on a surface that is not horizontal while supporting a user resting on the curved surface of the half cylinder, wherein the handles are configured to be removable from the handlebar, and wherein the handles are positioned at a spaced apart distance from the resting surface when the user is supported on the curved surface of the half cylinder.

* * * * *